US008047459B2

(12) United States Patent
D'Errico

(10) Patent No.: US 8,047,459 B2
(45) Date of Patent: Nov. 1, 2011

(54) CO-AXIAL BASKET MILL AND METHOD OF USE

(76) Inventor: Edward D'Errico, White Plains, NY (US)

( * ) Notice: Subject to any disclaimer, the term of this patent is extended or adjusted under 35 U.S.C. 154(b) by 0 days.

(21) Appl. No.: 12/494,150

(22) Filed: Jun. 29, 2009

(65) Prior Publication Data

US 2009/0321545 A1 Dec. 31, 2009

Related U.S. Application Data

(60) Provisional application No. 61/076,627, filed on Jun. 28, 2008.

(51) Int. Cl.
*B02C 17/18* (2006.01)

(52) U.S. Cl. ..... 241/21; 241/74; 241/171; 241/172

(58) Field of Classification Search ..... 241/21, 241/74, 171, 172
See application file for complete search history.

(56) References Cited

U.S. PATENT DOCUMENTS 5,184,783 A 2/1993 Hockmeyer et al.
5,346,147 A 9/1994 Ishikawa et al.
5,497,948 A 3/1996 Hockmeyer
5,820,040 A 10/1998 Hockmeyer et al.
5,934,579 A * 8/1999 Hiersche et al. ..... 241/65

OTHER PUBLICATIONS

The Hockmeyer HSD Immersion Mill One Step Solution 4 page brochure-unknown date.
Premier Submersible Mill, 2 pages, date unknown.

* cited by examiner

*Primary Examiner* — Mark Rosenbaum
(74) *Attorney, Agent, or Firm* — David Aker

(57) ABSTRACT

For use in a basket mill having a process vessel in which particles are ground so as to reduce their size, a basket for retaining a grinding medium, having an opening in its top and a screen at its bottom. A first shaft extends into the basket and has a grinding assembly extending from the shaft. A first drive apparatus rotates the first shaft at a first rotational rate. A second shaft is coaxial with the first shaft and has an impeller for causing material to be ground to move into the basket through the opening and out of said basket through the screen. A second drive apparatus rotates the second shaft at a second rotational rate independent of the first rotational rate. The first shaft may be a tube. A tube may be disposed within the first shaft, and have at its end a bushing for receiving for rotation the second shaft. The bushing may be located outside of a region of the basket where grinding media is disposed. Methods for operating the apparatus.

17 Claims, 2 Drawing Sheets

CO-AXIAL BASKET MILL AND METHOD OF USE

This application claims priority under 35 U.S.C. §119(e) from provisional patent application Ser. No. 61/076,627 filed on Jun. 28, 2008, the entire content of which is incorporated herein by reference.

BACKGROUND OF THE INVENTION

1. Field of the Invention

The present invention relates to apparatus and methods for grinding materials into fine particles. More particularly, it relates to those apparatus methods in which a basket mill is used.

2. Background Art

A basket mill is a machine used to reduce the particle size of slurries. Typical uses are for the manufacture of paint or ink where pigment particles must be reduced to microscopically small sizes.

Such mills can accommodate a wide range of volume depending on the volume and viscosity of the slurry to be processed. Typical volumes range from 0.5 liter for a table-top mill to as much as 40 liters for a full manufacturing mill.

Referring to FIG. 1, such machines typically have a process vessel 10 mounted to a dolly-like structure shown generally as 12 having four casters 14, so that process vessel 10 may be moved along a shop or other floor when grinding apparatus in accordance with the prior art, or according to the invention, as described below with respect to FIG. 2, is withdrawn upward from process vessel 10. Similarly the process vessel can be supplied without casters and therefore maintained in a fixed position. In general, a basket 16 is loaded with a large number of small beads (not shown). A mixture of the material being ground and the small beads are stirred by agitator discs or pins 18, which extend radially from a rotating agitator shaft 20. The beads typically can be from 0.5 mm to 6 mm in diameter. The beads can be made of various materials including glass or steel or ceramic. These beads are collectively known as "grinding media", and are well know in the art.

Thus, the agitator shaft 20, which has radially arranged discs or pins 18, is immersed into the grinding media and stirs the bead mass while a slurry 22 of the material being ground is introduced. It is the movement of the beads impacting against the particles of the material being ground which acts to reduce the particle size. This process is also known as "wet grinding". The basket 16, together with its contained grinding media, is immersed into a process vessel 10, which contains the slurry 22.

The slurry 22 is made to flow into the top of basket 16 through its generally open top 24 at 25. The beads are retained in the basket while allowing the slurry to pass through because the sidewall 26 and bottom wall 28 of the basket 16 are actually made of a screen material. In effect the container resembles a large basket, thus the name "basket mill".

Generally, there have been two designs of basket mills. In a first design, as illustrated in FIG. 1, the agitator shaft 20, driven to rotate by a suitable drive assembly 30 including a motor and an appropriate speed control for the motor has, mounted at the bottom of the drive shaft, an impeller 32 which serves, when it rotates with the agitator shaft 20, to draw slurry into the top of the basket 16, as illustrated by arrow 33. In another design (not shown), the bottom of the basket is closed, and one or more separate impellers are mounted alongside the basket.

In either of these prior art designs, the flow of slurry 22 into the basket 16 is dependent on the action of the impeller. The first type of machine, described above with respect to FIG. 1, is generally preferred due to the presence of the center-mounted impeller 32, but has numerous maintenance problems. Since the same shaft is use for both the agitator discs or pins 18 and the impeller 32, a stabilizing bushing 34 is required where the agitator shaft 20 passes through the bottom of basket 16. The bushing 34 is immersed in the grinding media mass. The attack of the grinding beads on the bushing 34 leads to frequent bushing replacement, because the bushing 34 is repeatedly worn by the action of the grinding media inside the basket. Further, the impeller 32 and agitator discs or pins 18, mounted on the same shaft 20, by necessity, must spin at the same speed.

With the separate propellers of the second design, the propeller is separate, so there is no need for the bottom mounted bushing of the first design which is under constant attack by the action of the grinding media However, the offset nature of the propeller does not provide the better flow, and control over the flow of material as in the first design.

Accordingly, there is a need for a better apparatus, and a method for its operation, which permits precise control of flow, without significant maintenance difficulties.

SUMMARY OF THE INVENTION

It is an object of the invention to provide basket mill in which the flow of slurry through the basket is precisely controlled.

It is a further object of the invention to provide a basket mill that does not require extensive maintenance.

It is another object of the invention to provide a basket mill wherein the process vessel may be used as a simple disperser.

It is yet another object of the invention to provide a basket mill in which grinding of particles may be accomplished with reduced energy consumption.

The inventor has determined that the basic design of the prior art, as illustrated in FIG. 1, prohibits optimum efficiency, because the optimal rotational speed for the agitator assembly is not generally the same as that for the impeller. In this prior art device, the operator must strike a balance with the result being that the speed chosen is not the best for either purpose.

Thus the above objects and others are achieved in accordance with the invention by the agitator assembly being spun at an optimum and particular speed suited to the material being processed. In addition, the impeller is optimally spun at a particular speed independently of the agitator. The speed of either of these elements is determined by the slurry viscosity and specific gravity. In accordance with the invention, the agitator elements are driven by a first shaft and the impeller is driven by a separate second shaft, which is coaxial with the first shaft. The impeller shaft can spin inside a separation tube within the agitator shaft.

By virtue of the separate adjustability of the two critical speeds, the operator can choose separate optimal shaft speeds for both functions, each speed being the best to achieve the desired results.

In addition to the advantages of the new design as described, there are further advantages.

1. There is no stabilizer bushing in contact with the grinding media, thus greatly decreasing required maintenance.
2. Furthermore, with the new design, the machine can be operated as a simple disperser by spinning only the impeller shaft without starting the main grinding media agitator shaft. This is useful since it eliminates a prior step in the process where the slurry must first be mixed in a separate disperser machine.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 2:
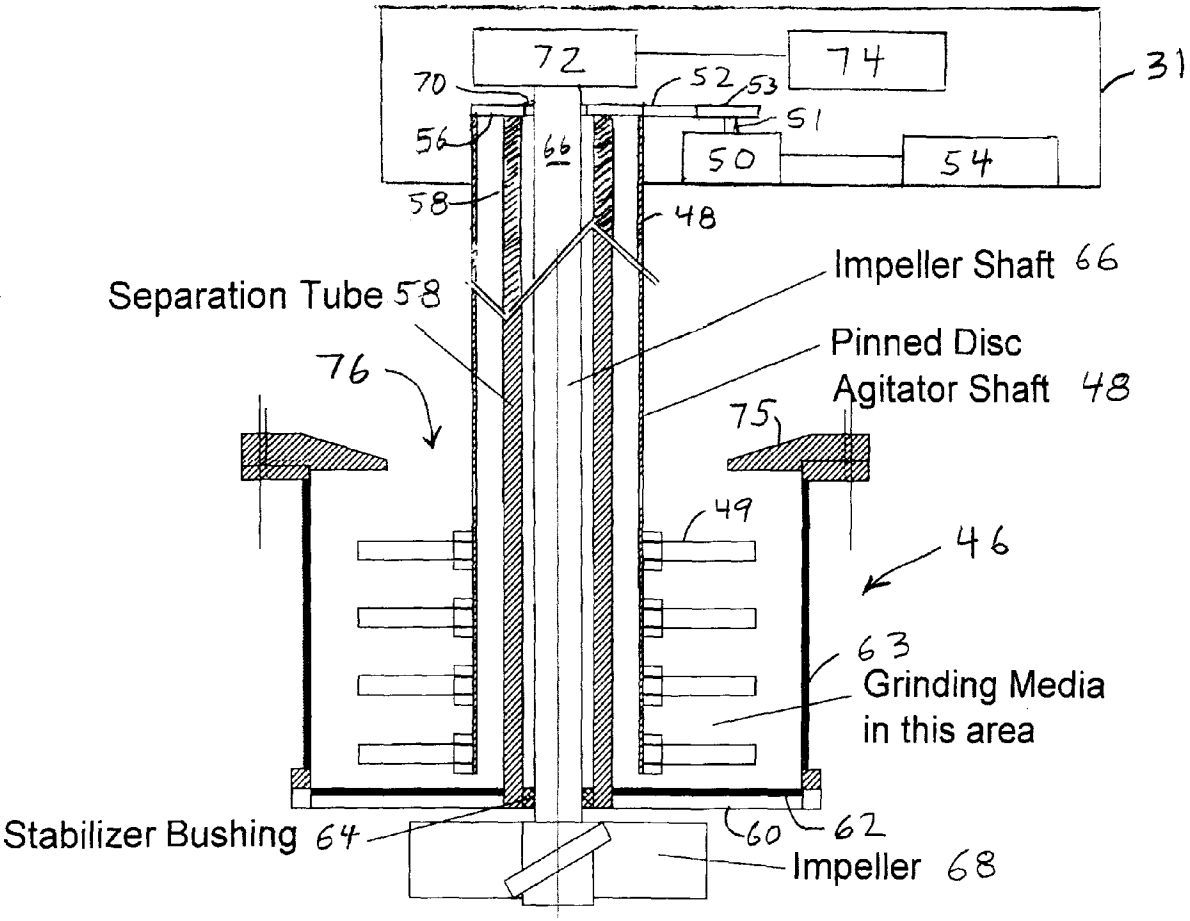
FIG. 2 is a cross sectional view of apportion of an apparatus in accordance with the invention.

Referring to FIG. 2, there is shown a cross-sectional view of a basket 46 and related apparatus incorporating features of the present invention. Although the present invention will be described with reference to the single embodiment shown in the drawing, it should be understood that the present invention can be embodied in many alternate forms of embodiments. In addition, any suitable size, shape or type of elements or materials could be used.

Figure 1:
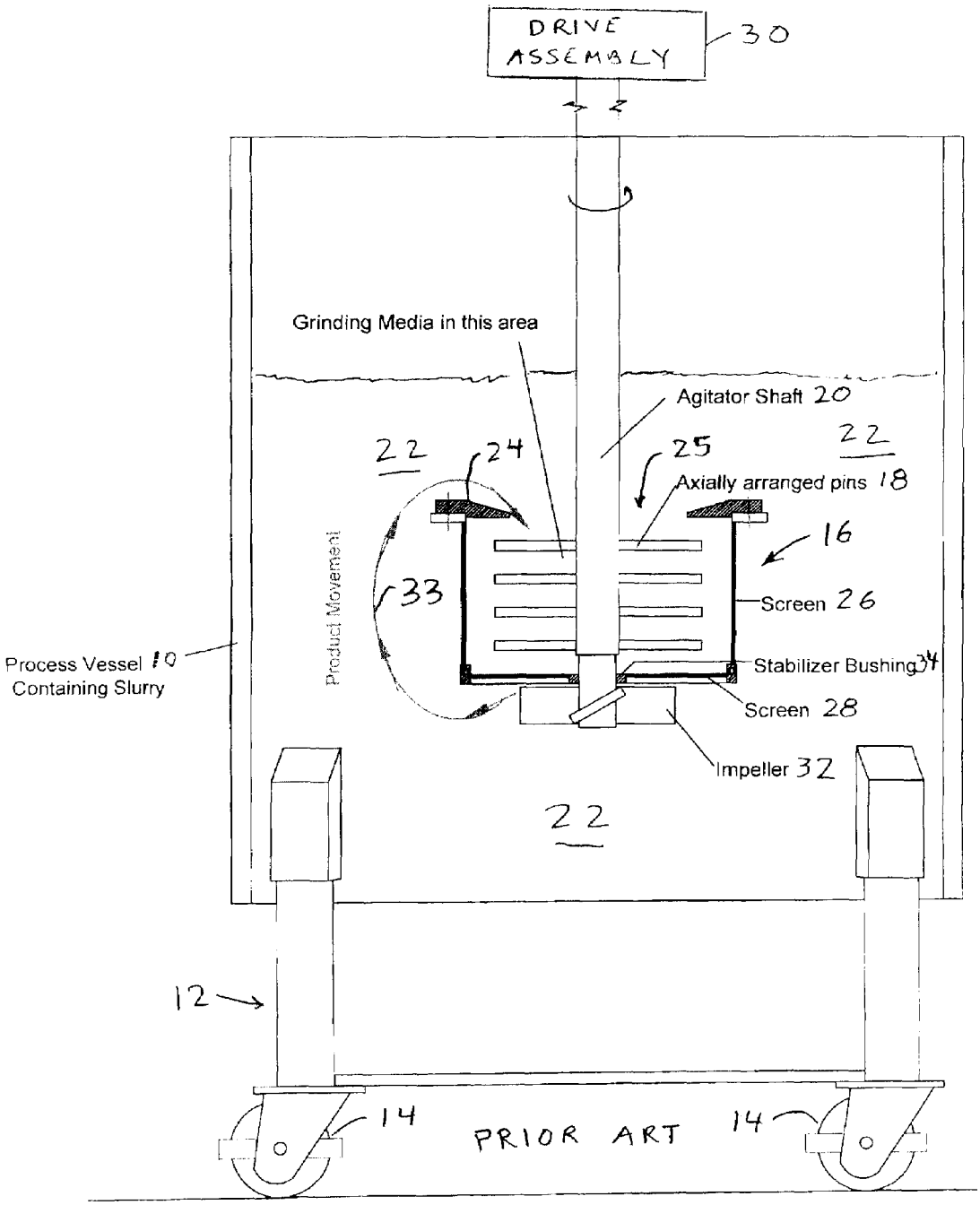
FIG. 1 is cross sectional view of a prior art apparatus.

Basket 46 may be utilized for grinding slurry 22 in a process vessel 10, as in FIG. 1. However, the structure is different than that of FIG. 1, as described below. A tubular agitator shaft 48, having pinned discs 49 extending radially therefrom to agitate the mixture in the basket 46, is rotated by a first electrical motor 50, within a drive assembly 31. Motor 50 has a shaft 51 and a pulley or gear 53 mounted for rotation with shaft 51. Pulley or gear 53 may be connected to shaft 48 by a belt or chain 52, respectively. An electrical speed control apparatus 54 controls the speed of rotation of motor 50, and therefore that of shaft 48. Shaft 48 has a planar cover 56 at its top to which a separation tube 58 is welded. Separation tube 58 is affixed to structural elements 60 of basket 46, supporting a lower wall screen 62. Separation tube 58 extends through an internal stabilizer bushing 64, which because of its position within separation tube 58, is not in contact with the grinding media and slurry within basket 46. Stabilizer bushing 64 receives within its internal opening, an impeller shaft 66, on which is mounted an impeller 68, positioned just below screen 62, so that when impeller 66 rotates, it causes slurry 22 to be drawn from the bottom of basket 46, into a process vessel 10 (FIG. 1) in which basket 46 is disposed. The other end of impeller shaft 66 extends through a bushing 70 in planar cover 56 to a second electrical drive motor 72 which rotates impeller shaft 66 at a speed determined by a second speed control apparatus 74. Thus, the rotational speeds of agitator shaft 48 and impeller shaft 66 may be independently controlled by input command or control values to speed control apparatus 54 and speed control apparatus 74, respectively. The rotational speed for grinding due to rotation of agitator shaft 48 can be optimized for a given slurry and the manner in which it is to be ground. Independently, the rate at which slurry is drawn into an opening 75 at the top 76 of basket 46, and thus circulated back out through bottom screen 62 and sidewall screen 63 is controlled by the separate rotational speed of impeller 68.

This independent rotational speed control has the advantage of optimizing the process of grinding the particles in the slurry to produce the best possible average particle size and size distribution, while, with proper adjustment, minimizing the amount of energy needed to grind the material. Further, as noted above, the invention has the advantages of not requiring a stabilizer bushing in contact with the grinding media, thus greatly decreasing required maintenance. In addition, the apparatus can be operated as a simple disperser by spinning only the impeller shaft without starting the main grinding media agitator shaft, thus eliminating a prior step in the process where the slurry must first be mixed in a separate dispersing machine.

It should be understood that the foregoing description is only illustrative of the invention. Various alternatives and modifications can be devised by those skilled in the art without departing from the invention. Accordingly, the present invention is intended to embrace all such alternatives, modifications and variances, which fall within the scope of the appended claims.

What is claimed is:

1. For use in a basket mill having a process vessel in which particles are ground so as to reduce their size, an apparatus comprising:

a basket having an opening in its top and a screen at its bottom, said basket being for retaining a grinding medium;

a first shaft extending into the basket and having a grinding assembly extending from the shaft;

a first drive apparatus for rotating said first shaft at a first rotational rate;

a second shaft coaxial with the first shaft, said second shaft having an impeller for causing material to be ground to move into said basket through said opening and out of said basket through said screen; wherein the first shaft is a first tube, and wherein a second tube is disposed within said first shaft, said second tube having at a first end of said second tube a bushing for receiving for rotation said second shaft, said bushing being located outside of a region of said basket where grinding media is disposed, so as not to be exposed to said grinding media; and a second drive apparatus for rotating said second shaft at a second rotational rate independent of said first rotational rate.

2. The apparatus of claim 1, wherein said bushing is located at the bottom of said basket.

3. The apparatus of claim 1, further comprising a tube closure member at a top of said first shaft, said tube being affixed at one end to said tube closure member.

4. The apparatus of claim 3, wherein said tube closure member has a bushing for rotational receiving said second shaft.

5. The apparatus of claim 1, wherein said first drive apparatus comprises a motor, said motor having a shaft with a first pulley, a second pulley disposed about said first shaft, and a belt for coupling between said first pulley and said second pulley.

6. The apparatus of claim 5, further comprising a speed control apparatus for allowing control of the rate of rotation of said motor.

7. The apparatus of claim 1, wherein said first drive apparatus comprises a motor, said motor having a shaft with a first gear, a second gear disposed about said first shaft, and a chain for coupling between said first gear and said second gear.

8. The apparatus of claim 7, further comprising a speed control apparatus for allowing control of the rate of rotation of said motor.

9. The apparatus of claim 1, wherein the first drive apparatus is configured to allow the rotational rate of the first shaft to be set to zero, so that the first shaft does not rotate.

10. The apparatus of claim 1, wherein said grinding assembly comprises one of grinding pins and grinding discs extending radially from said first shaft.

11. The apparatus in claim 1, in combination with a process vessel for receiving material having particles therein to be ground, and in which said apparatus is disposed when grinding said particles.

12. A method for operating a basket grinding mill, said grinding mill having a process vessel and an apparatus in accordance with claim 1 disposed therein, the method comprising:

placing material to be ground into the process vessel;

adjusting the rotational rate of the first shaft to said first rotational rate; and adjusting the rotational rate of the second shaft to a second rotational rate.

13. The method of claim 12, wherein the second rotational rate is adjusted independently of said first rotational rate.

14. The method of claim 12, wherein said first rotational rate is adjusted to facilitate grinding of said particles.

15. The method of claim 12, wherein said second rotational rate is adjusted to facilitate flow of material through said basket.

16. The method of claim 12, further comprising, after placing said material to be ground into the process vessel, setting the rotational rate of the first shaft to zero while setting the rotational rate of the second shaft to be other than zero, so as to mix the material, prior to the material being ground.

17. A method for operating a basket grinding mill, said grinding mill having a process vessel and an apparatus in accordance with claim 1 disposed therein, the method comprising the steps of:

placing material to be ground into the process vessel;

setting the rotational rate of the first shaft to zero while setting the rotational rate of the second shaft to be other than zero, so as to mix the material;

after mixing has occurred, setting the rotational rate of the second shaft to a rotational rate other than zero; and said rotational rate other than zero of the first shaft and said rotational rate other than zero of said second shaft being selected to optimize grinding of said material;

said steps being performed in the order set forth above.

* * * * *